US006755419B2

(12) United States Patent
Markus

(10) Patent No.: US 6,755,419 B2
(45) Date of Patent: Jun. 29, 2004

(54) INTELLECTUAL GAME INVOLVING MULTI-VARIABLE ANALYSIS

(76) Inventor: Donalee Markus, 484 Hillside Dr., Highland Park, IL (US) 60035

( * ) Notice: Subject to any disclaimer, the term of this patent is extended or adjusted under 35 U.S.C. 154(b) by 0 days.

(21) Appl. No.: 10/267,448

(22) Filed: Oct. 10, 2002

(65) Prior Publication Data

US 2004/0070144 A1 Apr. 15, 2004

(51) Int. Cl.[7] ..... A63F 3/06
(52) U.S. Cl. ..... 273/273; 273/293; 463/9
(58) Field of Search ..... 273/273, 264, 273/271, 276, 292, 293, 294; 463/9

(56) References Cited

U.S. PATENT DOCUMENTS

| | | | | |
|---|---|---|---|---|
| 1,450,874 A | | 4/1923 | Stromee | |
| 2,072,605 A | | 3/1937 | Palmer | |
| 2,228,180 A | | 1/1941 | Pauli | |
| 3,547,444 A | | 12/1970 | Williams | |
| 3,680,866 A | * | 8/1972 | Kerr | 273/293 |
| 3,773,327 A | * | 11/1973 | Kremer | 273/294 |
| 3,830,502 A | * | 8/1974 | Rodgers | 273/273 |
| 4,659,085 A | | 4/1987 | DeVries | |
| 4,715,605 A | | 12/1987 | Fritzman | |
| 4,778,188 A | | 10/1988 | Brooker | |
| 5,803,461 A | | 9/1998 | Pavlovic | |
| 6,102,401 A | | 8/2000 | Segman et al. | |

FOREIGN PATENT DOCUMENTS

| | | |
|---|---|---|
| FR | 2692805 | * 6/1992 |
| WO | 89/09085 | * 10/1989 |
| WO | 90/08581 | * 8/1990 |

* cited by examiner

*Primary Examiner*—William M. Pierce
(74) *Attorney, Agent, or Firm*—McDermott, Will & Emery

(57) ABSTRACT

An intellectual game for rehearsing cognitive skills for complex critical thinking involving the analysis of multiple variables. The intellectual game includes a set of playing cards, or alternatively, computer software for playing the intellectual game. Each of the playing cards includes an image representing a value for each of a plurality of criterions. Each of the plurality of criterions are associated with a different edge of the playing card. The playing cards are matched to each other along their edges based on the corresponding values of the criterions associated with the matching edges. The computer software embodiment of the intellectual game includes a pattern of icons representing values for each of a plurality of criterion. The icons are matched to each other based upon the values of the criterions via selection markers.

20 Claims, 7 Drawing Sheets

INTELLECTUAL GAME INVOLVING MULTI-VARIABLE ANALYSIS

FIELD OF THE INVENTION

The present invention relates to an intellectual game. Specifically, the present invention provides an intellectual game for the rehearsal of cognitive skills for multivariable analysis.

BACKGROUND OF THE INVENTION

Problem-solving and decision-making skills are important in both personal and professional situations. It is understood that effective problem-solving and decision-making is based, at least in part, by the number of variables a problem solver or decision maker is capable of evaluating. It has been found that most adults frequently make decisions based on an analysis of no more than one or two of the available variables. However, people that are better at manipulating a greater number of variables and constructing mental simulations based on these variables are capable of better problem-solving and decision-making, often resulting in better decisions and more desirable results.

It has been shown that people can be trained to increase the number of variables they are capable of evaluating by actively engaging in problem-solving activities involving analysis of a greater number of variables. By rehearsing this type of critical thinking, people improve their ability to evaluate relationships between variables and habituate their improved decision making skills. As a result, people integrate their improved decision-making skills on a subconscious level in all forms of personal and professional decision-making. It has further been shown that supplementing problem-solving activities with critical feedback maximizes the benefits provided by the problem-solving activities.

Rehearsing cognitive skills in a game format encourages participants to explore the learning process in a fun and risk-free environment. Moreover, practicing cognitive skills in a game format allows participants to learn both from their own play, as well as the play of the other participants. Finally, game formats that include scoring and/or solutions help to provide critical feedback to maximize the benefits of rehearsing cognitive skills.

SUMMARY OF THE INVENTION

The present invention provides an intellectual game for rehearsing cognitive skills for complex critical thinking involving the analysis of multiple variables. In one embodiment of the present invention, a set of cards is provided for playing the intellectual game. In another embodiment of the present invention, computer software is provided for playing the intellectual game.

It is an advantage of the present invention to provide an intellectual game that involves decision-making based on multi-variable analysis.

It is another advantage of the present invention to provide a set of playing cards for playing the intellectual game of the present invention.

It is a further advantage of the present invention to provide a multi-player intellectual game involving decision-making based on multi-variable analysis utilizing a set of playing cards.

It is, moreover, an advantage of the present invention to provide a single-player intellectual game involving decision-making based on multi-variable analysis utilizing a set of playing cards.

It is another advantage of the present invention to provide computer software for playing the intellectual game of the present invention.

Additional features and advantages of the present invention are described in, and will be apparent from, the detailed description of the presently preferred embodiments and from the drawings.

DETAILED DESCRIPTION OF THE PREFERRED EMBODIMENTS

Figure 1:
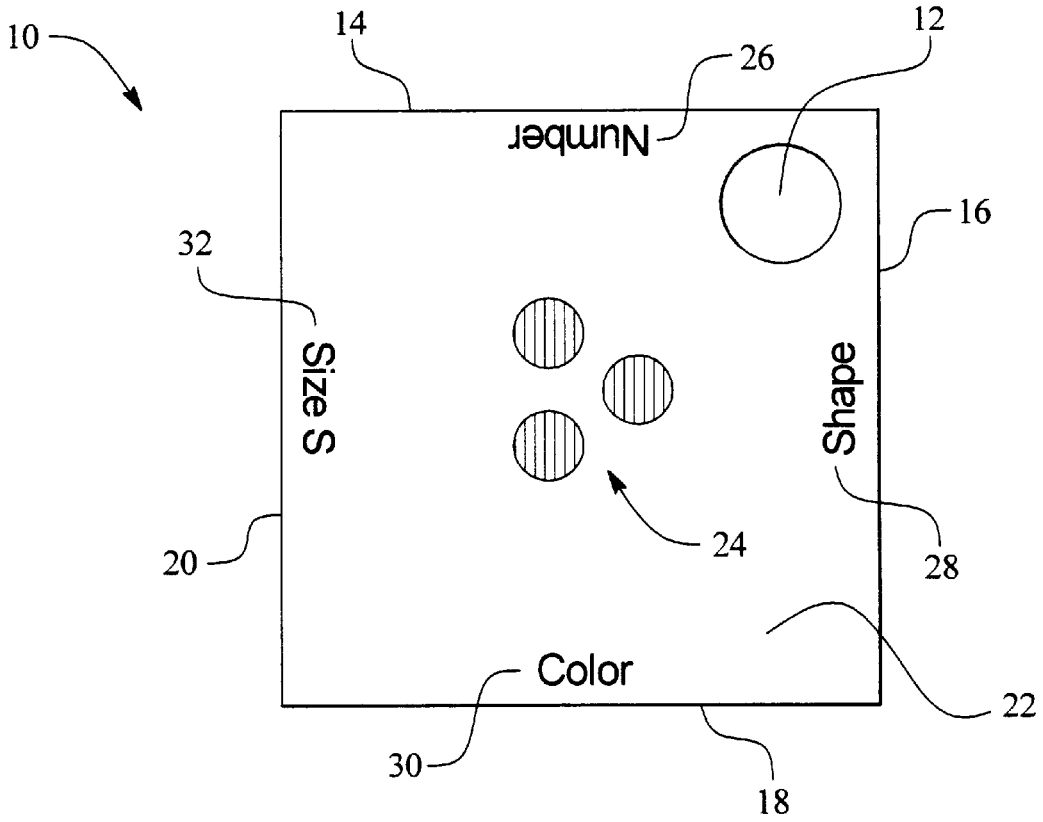
FIG. 1 is a top view of a playing card for use in the intellectual game of the present invention.

FIG. 1 illustrates an example of a playing card 10, a plurality of which may be included in a set for playing the intellectual game of the present invention. As shown, the playing card 10 is a square having a first edge 14, a second edge 16, a third edge 18, a fourth edge 20, and a face 22. An image 24 is provided on the face 22 of the playing card 10, a first criterion 26 is provided along the first edge 14, a second criterion 28 is provided along the second edge 16, a third criterion 30 is provided along the third edge 18, and a fourth criterion 32 is provided along the fourth edge 20. The playing card 10 of the present invention is not limited to being square shaped. For example, the playing cards 10 may be formed in the shape of a triangle, a pentagon, a hexagon, an octagon, etc. The playing cards may be provided in sets wherein the playing cards are uniformly shaped and, alternatively, in sets wherein the playing card are non-uniformly shaped.

For convenience, the first edge 14, the second edge 16, the third edge 18, and the fourth edge 20 of the playing card 10 are collectively referred to herein as the edges 14, 16, 18, and 20. Similarly, the first criterion 26, the second criterion 28, the third criterion 30, and the fourth criterion 32 are collectively referred to herein as the criteria 26, 28, 30, and 32. It should be recognized that the descriptions and references herein to the edges 14, 16, 18, and 20 and to the criteria 26, 28, 30, and 32 may be applied to a playing card 10 having a different number of edges and a different number of criteria than described herein.

In one embodiment of the present invention, each playing card 10 is a perfect square that is one and three-quarters inches along each of the edges 14, 16, 18, and 20. Alternatively, the playing card 10 may be provided having larger dimensions for players having diminished motor skills, such as older or handicapped players. For example, the playing card 10 may be a perfect square that is three and one-half inches along each of the edges 14, 16, 18, and 20. Additionally, as shown in FIG. 1, a cutout portion 12 of the playing card 10 may be provided to make it easier for the playing cards 10 to be moved on a flat surface. In the embodiment shown in FIG. 1, the cutout portion 12 is a half inch diameter circle removed from the corner of each of the playing cards 10. Of course, the present invention is in no way dependent upon the size of the edges of the cutout portion.

Figure 2:
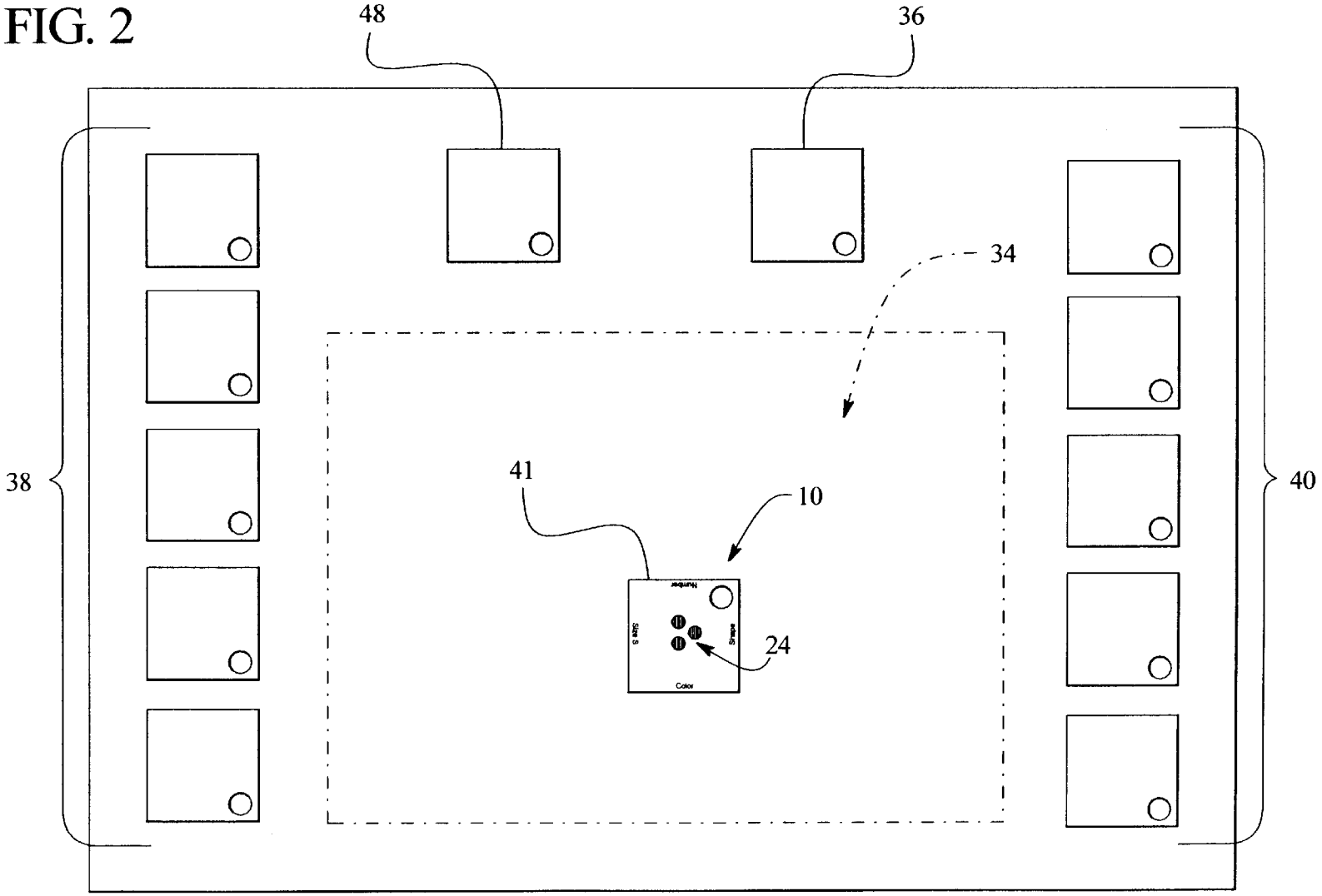
FIG. 2 is a top view schematic illustrating a game setup for playing the intellectual game of the present invention.

The intellectual game of the present invention involves matching the various playing cards from the set along their edges on a playing surface 34 (FIG. 2). Accordingly, the playing card 10 has a value associated with each of its edges 14, 16, 18, and 20. The value associated with each of the edges 14, 16, 18, and 20 is determined by referencing both the image 24 and the criteria 26, 28, 30, and 32 provided on the playing card 10.

For example, the image 24 shown in FIG. 1 depicts three, small, red circles. It should be noted that colors are depicted in FIGS. 1–10 using the patterns specified in section 608.02 of the eighth edition of the Manual of Patent Examining Procedure. As further shown in FIG. 1, the word "Number" is printed along the first edge 14, the word "Shape" is printed along the second edge 16, the word "Color" is printed along the third edge 18, and the word "Size" is printed along the fourth edge 20. Accordingly, the value associated with the first edge 14 of the playing card 10 shown in FIG. 1 is the number three; the value associated with the second edge 16 of the playing card 10 is shape of a circle; the value associated with the third edge 18 of the playing card 10 is the color red; and the value associated with the fourth edge 20 of the playing card 10 is the size small.

As additionally shown in FIG. 1, the letter "S" is printed next to the word "Size" along the fourth edge 20 to indicate that the size value associated with the image 24 is small. Similarly the letters "L" and "M" may be used to indicate size values of large and medium, respectively. Further, additional letters or symbols may be used to indicate the size value represented by the image 24. It is contemplated that additional letters or symbols may be provided along any of the edges 14, 16, 18, and 20 of the playing cards 10 to further indicate the values associated with the edges 14, 16, 18, and 20. For example, it may be beneficial to provide a letter or symbol indicating the color value associated with the image 24 to assist colorblind players.

In one embodiment of the set of playing cards of the present invention, the set includes three hundred twenty-four, square-shaped playing cards, each patterned on the playing card 10 described above and having color, shape, size, and number criteria 26, 28, 30, and 32. As shown with reference to the playing card 10 illustrated in FIG. 1, each of the playing cards in the set includes a unique image 24 derived from a combination of one of six shape values, one of six color values, one of three size values, and one of three number values; the six shape values are circles, squares, triangles, cones, stars, and pentagons; the six color values are red, orange, yellow, green, blue, and pink; the three size values are small, medium, and large; and the three number values are one, two, and three. It is recognized that any other variables or number of variables may be used to comprise the image 24.

With reference now to FIGS. 2–5, one embodiment of the intellectual game of the present invention utilizing the set of playing cards will be described. FIG. 2 illustrates a playing surface 34, a deck 36, a first player's hand 38, a second player's hand 40, and a discard pile 48. The first player's hand 38 and the second player's hand 40 are collectively referred to herein as the player's hands 38 and 40, and referred to in the alternative as the player's hand 38 or 40. Although the intellectual game is described herein with reference to two players, the intellectual game may be played by any number of players. Greater numbers of players may be accommodated by increasing the number of playing cards in the set, whether by increasing the number of criteria, increasing the number of variables within each of the criteria (i.e., increasing the number of colors from 6 to 10) or by repeating the images on multiple playing cards.

To begin the intellectual game, the set of playing cards is shuffled by one of the players. The player that shuffles the set of playing cards is designated as the dealer. After the set is thoroughly shuffled, each player is dealt five playing cards to be included in each of the corresponding player's hands 38 and 40. The playing cards may be dealt face down or face up as predetermined by the players. After each player has been dealt five playing cards, the remaining playing cards are placed in a stack, face down, next to the playing surface 34 and are designated as the deck 36. The dealer then draws a playing card from the top of the deck 36 and places the drawn playing card face up in the center of the playing surface 34. The drawn playing card is designated as the initial playing card 41. Play then begins with the player seated on the dealer's left side.

The object of the intellectual game is to earn more points than the other players. Points are awarded for matching playing cards from the players' hands 38 and 40 to the playing cards located on the playing surface 34, as described below. In the example illustrated in FIG. 2, the first player is the player to the left of the dealer and therefore is the first to play. The first player attempts to match a playing card from the first player's hand 38 with the initial playing card 41 located face up on the playing surface 34. As shown in FIG. 2, the initial playing card 41 has an image 24 of three small red circles. To create a match, the first player may match any of the four criteria 26, 28, 30, and 32 (FIG. 1) shown on the initial playing card 41, i.e. the number three, the small size, the color red, or the circular shape.

Figure 3:
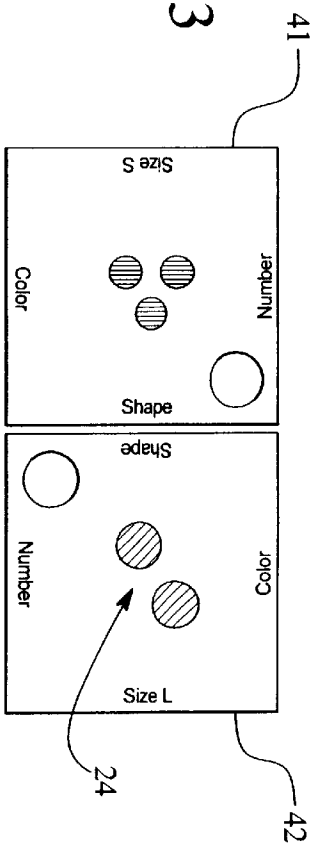
FIG. 3 is a top view illustrating a first match of playing cards of the intellectual game of the present invention.

Turning now to FIG. 3, the first player matches the initial playing card 41 by playing a first played card 42 having an image 24 of two, large, green circles. As shown in FIG. 3, a match is made along the "Shape" edge of each playing card because both playing cards have images of circles. Accordingly, the first player is awarded one point for the match. The first player may continue to make matches as long as there are playing cards in the first player's hand 38 that can be matched to the playing cards located on the playing surface 34. If a player matches all five of the playing cards located in the player's hand 38 or 40 the player's score for that turn is doubled.

Figure 4:
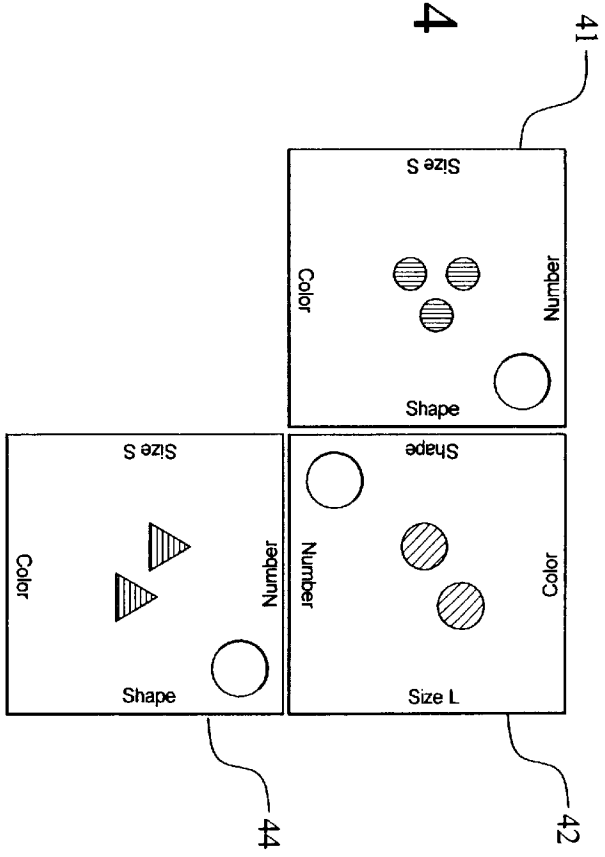
FIG. 4 is a top view illustrating a second match of playing cards of the intellectual game of the present invention.
Figure 5:
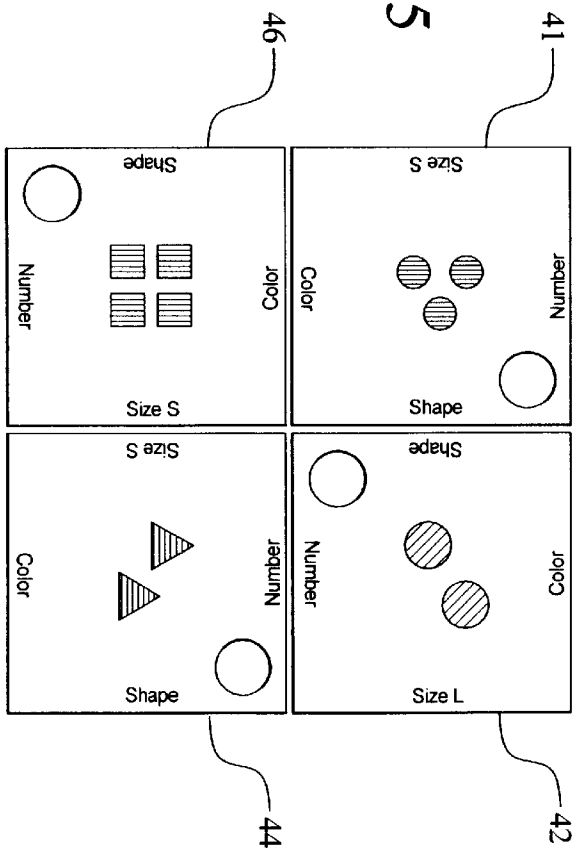
FIG. 5 is a top view illustrating a third match of playing cards of the intellectual game of the present invention.

Multiple points may be awarded for the play of a single playing card. A playing card may be matched along more than one of the edges, denoted as 14, 16, 18, and 20 in the playing card 10 described above with reference to FIG. 1, and a point is awarded for each of the edges that is matched. As shown in FIG. 4, the first played card 42 has been matched by a second played card 44 such that the three playing cards form an "L" shape. Now turning to FIG. 5, a third played card 46 is matched to both the first played card 42 and the second played card 44 such that two point are awarded to the player playing the third played card 46. Similarly, it is possible to match a playing card along any number of the edges.

Referring back to FIG. 2, during a player's turn, the player must place the playing cards onto the playing surface 34 one playing card at a time and announce each of the matches for each playing card played. Any of the other players may challenge the matches announced. If the challenged match is improper, the challenging player is awarded one point, the mismatched playing card is returned to the challenged player's hand 38 or 40, and the challenged player's turn ends. Alternatively, when a player can make no more matches from the playing cards located in the player's hand 38 or 40, the player's turn ends. Once the player's turn has ended, the player must draw playing cards from the deck 36 until the player's hand 38 or 40 consists of five playing cards. Play then continues to that player's left. The intellectual game continues until no matches can be made from any of the players' hands 38 and 40, after all the playing cards in the set have been played, after a player reaches a predetermined number of points, or after a predetermined number of rounds. The winning player is the player that has accumulated the greatest number of points when the game ends.

Alternate versions of the game are contemplated. For example, if the playing surface 34 is not large enough to accommodate the entire set of playing cards, the players may elect to play a predetermined number of rounds, each round ending after the dealer's turn is completed. When the final predetermined round is completed, the playing cards on the playing surface 34 are gathered and placed face down in the discard pile 48 as shown in FIG. 2. Play then continues with the dealer placing the playing card now located at the top of the deck 36 face up on the playing surface 34. Play then continues to the dealer's left and the points are added to the points accumulated in the previous rounds.

Figure 6:
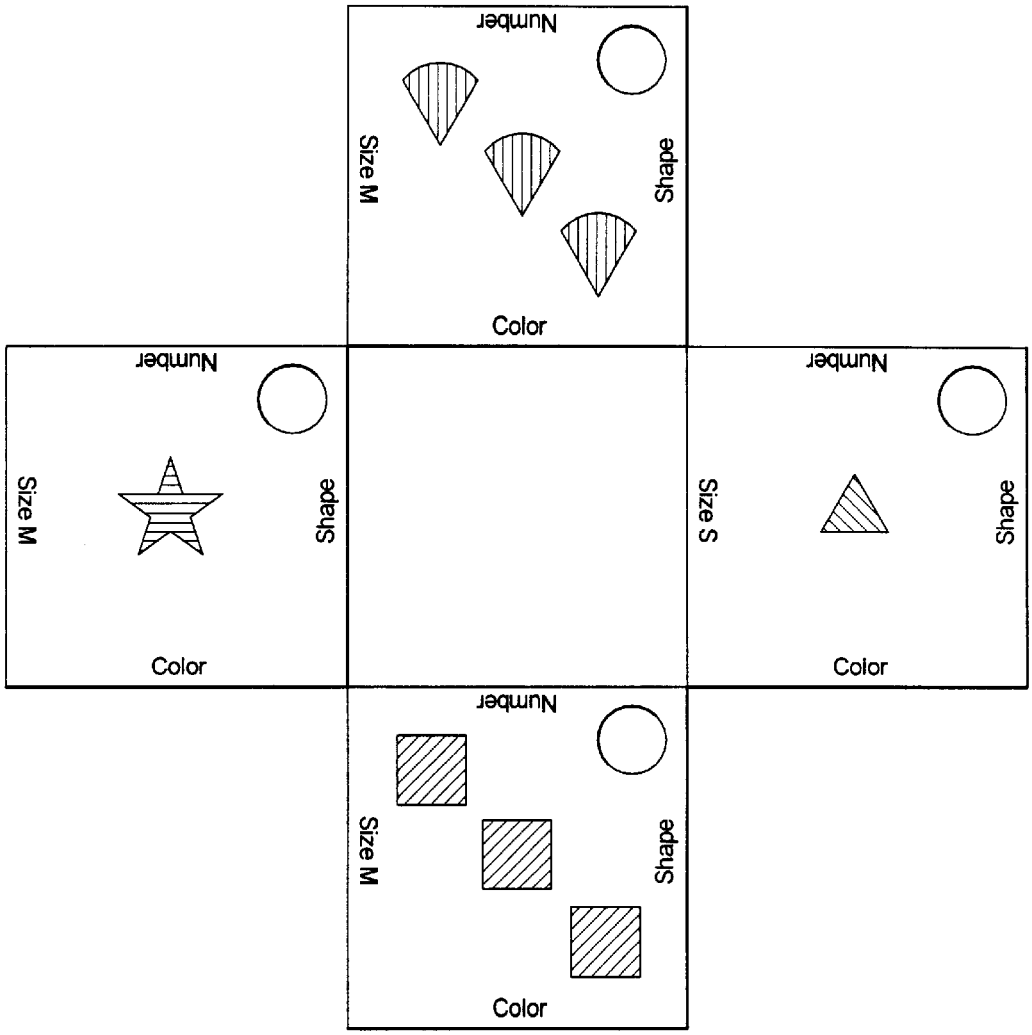
FIG. 6 is a schematic illustrating a game setup for playing an intellectual game in another embodiment of the present invention.

An alternate version of the intellectual game of the present invention is illustrated in FIG. 6. After the set of playing cards have been thoroughly shuffled, four playing cards are arranged on the playing surface in the form shown in FIG. 6, and the remaining playing cards are placed in a stack, face down, next to the playing surface and to form the deck. The object of the intellectual game is to form a square of playing cards on the playing surface. The intellectual game may be played solitaire, or with two or more players.

Figure 7:
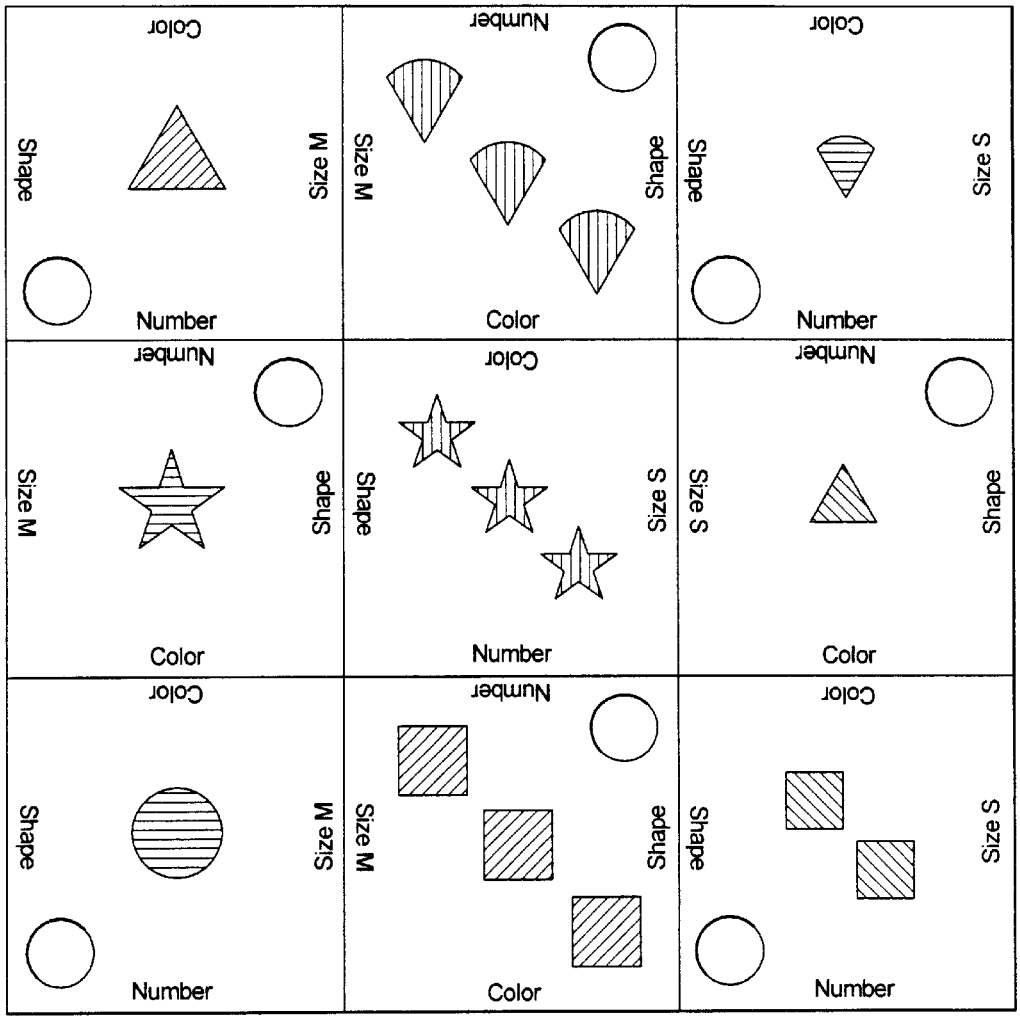
FIG. 7 is a schematic illustrating the completion of the embodiment of the intellectual game of the present invention shown in FIG. 6.

If the intellectual game is played as solitaire, the player begins by taking the playing card located at the top of the deck and tries to match it to the playing cards located on the playing surface. If a match cannot be made, the playing card is placed in the discard pile and draws the top playing card from the deck. The intellectual game is won when the player forms a perfect square on the playing surface, for example, as shown in FIG. 7.

If two or more players participate in the intellectual game, play begins to the dealers left. The first player draws a playing card from the deck and attempts to match the playing card to the playing cards on the playing surface. If a match is made, the player's turn ends. If no match is made, the player continues to draw playing cards from the deck one at a time until a match is made. The player retains all of the unmatched playing cards drawn during the turn. Once the player's turn has ended, play continues to the player's left. After each of the players has completed their first turn, the first round is complete. After the first round, players may use the playing cards acquired in previous rounds or draw from the deck when attempting to make a match on the playing surface. Players may only play one playing card per turn. The game is over when the playing cards on the playing surface form a square and the player with the least number of playing cards wins.

In the multi-player version of the intellectual game described with reference to FIGS. 6 and 7, players may challenge matches made by other players. If the challenged match is an improper match, the challenged player must take the challenged card back and take one playing card from the challenging player. If the challenged match is a proper match, the challenging player must take one playing card from the challenged player.

Figure 8:
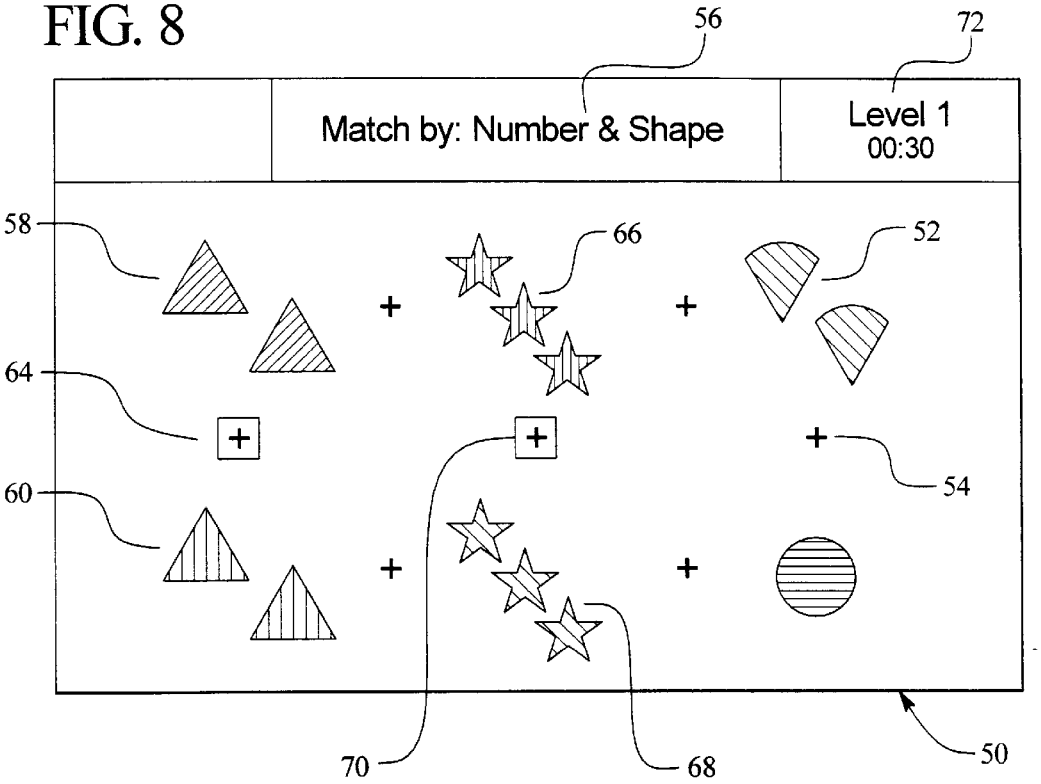
FIG. 8 is a screen shot depiction illustrating a computer software embodiment of the intellectual game of the present invention.

In addition to the versions of the intellectual game described above with reference to FIGS. 1–7, the intellectual game of the present invention may alternatively be played utilizing computer software rather than physical playing cards. FIG. 8 depicts a screen shot of an embodiment of a computer software version of the intellectual game of the present invention. As shown in FIG. 8, a game screen 50 is provided displaying a pattern of icons 52. An icon 52 is analogous to the image 24 provided on the face 22 of the playing card 10 described above with reference to FIG. 1. Each of the icons 52 shown in FIG. 8 conveys a value in each of the following categories; color, number, shape, size, and direction. Selection markers 54 are located between the icons 52 such that each icon 52 is associated with each horizontally or vertically adjacent icon 52 via one of the selection markers 54. Additional selection markers (not shown) may be provided such that the icons 52 may be associated in other patterns, such as, for example, diagonally. In the embodiment illustrated in FIG. 8, the icons 52 and selection markers 54 are arranged in a grid-like, square pattern. However, the icons 52 and the selection markers 54 may be arranged in other patterns including triangles, pentagons, hexagons, octagons, etc.

The object of the embodiment of the intellectual game shown in FIG. 8 is to complete rounds of play by analyzing and matching adjacent icons 52 using predetermined selection criteria. As shown in FIG. 8, the game screen 50 includes a selection criteria message 56 for displaying the predetermined selection criteria instructions. Matching of adjacent icons 52 is accomplished via the selection marker 54 that associates the matching icons 52. In the example shown in FIG. 8, the selection criteria message 56 provides that icons 52 are to be matched based on the size and the number values associated with the icons 52. Accordingly, as shown in FIG. 8, a first matching icon 58 and a second matching icon 60 are properly matched via a first matching selection marker 64 as both the first matching icon 58 and the second matching icon 60 are medium-sized icons 52 having a number value equal to two. The square displayed around the first matching selection marker 64 is provided to indicate a proper match between the first matching icon 58 and the second matching icon 60 has been identified. Similarly, a third matching icon 66 and a fourth matching icon 68 are properly matched via a second matching selection marker 70 as both the third matching icon 66 and the fourth matching icon 68 are large icons 52 having a number value equal to one. Selection of the first matching selection marker 64 and the second matching selection marker 70 is accomplished via an input device (not shown), such as, for example, a mouse or a keyboard.

The intellectual game shown in FIG. 8 is played in rounds wherein, as the intellectual game progresses to later rounds, the difficulty of the intellectual game increases. Each round is complete when either all of the matches on the game screen 50 have been selected or a predetermined length of time has expired. As shown in FIG. 8, a timer 72 is provided for visually representing the length of time remaining for the player to complete the present round. Although any length of time may be used to define a round, in the example shown in FIG. 8 the round is thirty seconds long.

Figure 9:
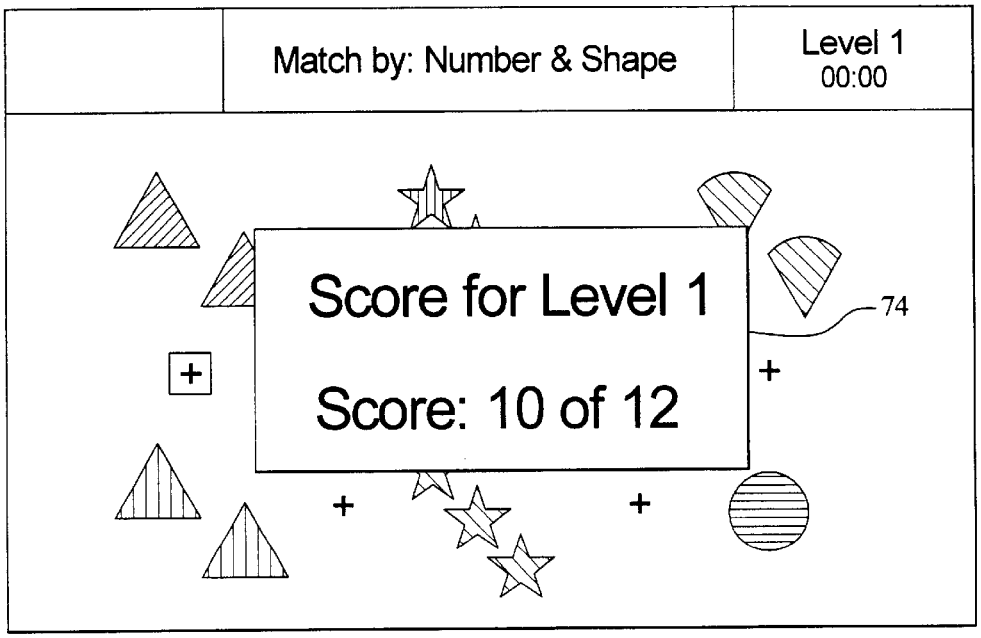
FIG. 9 is a screen shot depiction illustrating a feedback screen for the intellectual game of the present invention.

At the end of each round, a feedback screen 74, as shown in FIG. 9, may be provided to display the number of matches properly selected by the player relative to the total number of possible matches displayed on the game screen 50. The feedback screen 74 may display numerical feedback, such as the percentage of the matches available in the that were completed, or visual feedback, such as through the use of charts. Further, audio feedback may be provided in addition to or in the alternative to the feedback screen 74.

In the embodiment of the intellectual game illustrated in FIG. 8, the selection criteria message 56 may include any number of criterion. For example, in a beginning round, the selection criteria message 56 may include one criterion or two criteria by which proper matches are to be selected. As the difficulty increases, the number of criterion included in the selection criteria message 56 may increase. For example, in a later round, the selection criteria message 56 may instruct the player to match adjacent icons 52 that have identical values for size, color, and direction. In addition, the difficulty of a given round may be adjusted by altering the number of icons 52 displayed on the game screen 50, altering the pattern used to display the icons 52, or decreasing the time provided to complete the round.

Figure 10:
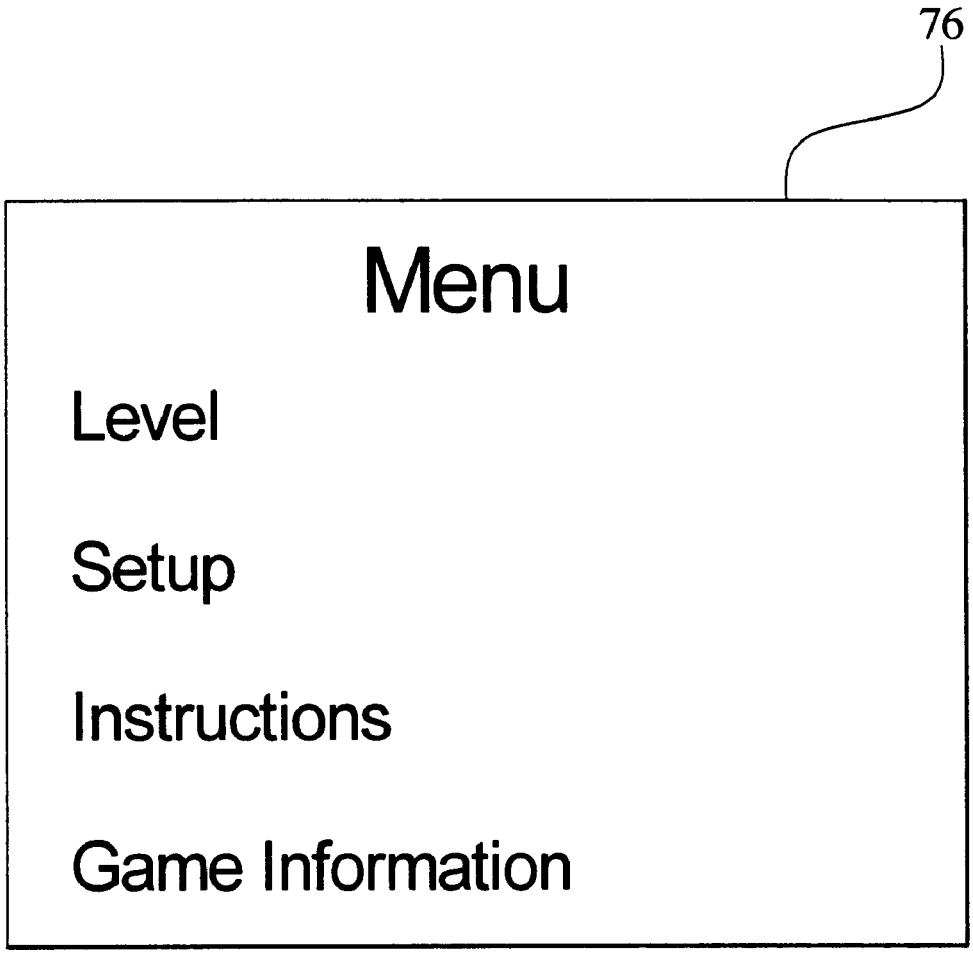
FIG. 10 is a screen shot depiction illustrating a menu screen for the intellectual game of the present invention.

As shown in FIG. 10, a menu screen 76 may be provided such that the player may select a desired round, difficulty, or otherwise adjust the game setup or parameters. As shown in FIG. 10, the menu screen may additionally provide access to information about the intellectual game such as, for example, instructions for playing the intellectual game. Additional layers of menus may be provided as would be apparent to one skilled in the art.

It should be noted that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. An intellectual game for rehearsing cognitive skills comprising:

a set of cards, each card including a face, a first edge, a second edge, a third edge and a fourth edge;

an image located on said face, said image representing at least a shape, a color, a size and a number;

said first edge including a shape indicia;

said second edge including a color indicia;

said third edge including a size indicia an; and said fourth edge including a number indicia.

2. The intellectual game for rehearsing cognitive skills of claim 1 wherein said image represents a shape selected from the group consisting of a circle, a square, a triangle, a cone, a star and a pentagon.

3. The intellectual game for rehearsing cognitive skills of claim 1 wherein said image represents a color selected from the group consisting of red, orange, yellow, green, blue and pink.

4. The intellectual game for rehearsing cognitive skills of claim 1 wherein said image represents a size selected from the group consisting of small, medium and large.

5. The intellectual game for rehearsing cognitive skills of claim 1 wherein said image represents a number selected from the group consisting of one, two and three.

6. The intellectual game for rehearsing cognitive skills of claim 1 wherein said shape indicia is the text "shape" printed along said first edge.

7. The intellectual game for rehearsing cognitive skills of claim 1 wherein said color indicia is the text "color" printed along said second edge.

8. The intellectual game for rehearsing cognitive skills of claim 1 wherein said size indicia is the text "size" printed along said third edge.

9. The intellectual game for rehearsing cognitive skills of claim 1 wherein said size indicia is the text "number" printed along said fourth edge.

10. The intellectual game for rehearsing cognitive skills of claim 1 wherein each of said cards includes a cutout portion.

11. A game piece for an intellectual game for rehearsing cognitive skills comprising:

a playing card including a face, a first edge, a second edge and a third edge;

an image located on said face, said image including a value for at least three different criteria, wherein each of said at least three different criteria is selected from the group consisting of color, number, shape, size and direction;

a first indicia placed along said first edge;

a second indicia placed along said second edge; and a third indicia placed along said third edge, wherein said first indicia, said second indicia and said third indicia are each a different indicia and are each selected from the group consisting of color, number, shape, size and direction.

12. The game piece for an intellectual game for rehearsing cognitive skills of claim 4 wherein said first indicia placed along said first edge is the text "color" printed along said first edge, said second indicia placed along said second edge is the text "number" printed along said second edge and said third indicia placed along said third edge is the text "shape" printed along said third edge.

13. The game piece for an intellectual game for rehearsing cognitive skills of claim 11 wherein said first indicia placed along said first edge is the text "number" printed along said first edge, said second indicia placed along said second edge is the text "shape" printed along said second edge and said third indicia placed along said third edge is the text "size" printed along said third edge.

14. The game piece for an intellectual game for rehearsing cognitive skills of claim 11 wherein said first indicia placed along said first edge is the text "shape" printed along said first edge, said second indicia placed along said second edge is the text "size" printed along said second edge and said third indicia placed along said third edge is the text "direction" printed along said third edge.

15. The game piece for an intellectual game for rehearsing cognitive skills of claim 11 wherein said playing card further comprises a fourth edge including a fourth indicia placed along said fourth edge, wherein said fourth indicia is selected from the group consisting of color, number, shape, size and direction and said fourth indicia and each of said first indicia, second indicia, third indicia and said fourth indicia are different indicia.

16. The game piece for an intellectual game for rehearsing cognitive skills of claim 15 wherein said first indicia placed along said first edge is the text "color" printed along said first edge, said second indicia placed along said second edge is the text "shape" printed along said second edge, said third indicia placed along said third edge is the text "size" printed along said third edge and said fourth indicia placed along said fourth edge is the text "number" printed along said fourth edge.

17. The game piece for an intellectual game for rehearsing cognitive skills of claim 15 wherein said first indicia placed along said first edge is the text "shape" printed along said first edge, said second indicia placed along said second edge is the text "size" printed along said second edge, said third indicia placed along said third edge is the text "direction" printed along said third edge and said fourth indicia placed along said fourth edge is the text "color" printed along said fourth edge.

18. An intellectual game for rehearsing cognitive skills comprising:

a game screen;

a pattern of a plurality of icons within said game screen, each of said icons including a value for at least three different criteria, wherein each of said at least three different criteria is selected from the group consisting of color, number, shape, size and direction;

a plurality of selection markers, wherein one of said plurality of selection marker is located between each pair of adjacent icons within said game screen; and selection criteria including a plurality of indicia located within said game screen, wherein said plurality of indicia is selected from the group consisting of color, number, shape, size and direction, wherein a player of the intellectual game identifies matching adjacent icons by selecting said selection markers located between said matching adjacent icons, said matching adjacent icons being defined as adjacent icons that have identical values for the criteria provided by said selection criteria.

19. The intellectual game for rehearsing cognitive skills of claim 18 wherein said selection criteria is the text "color and number."

20. The intellectual game for rehearsing cognitive skills of claim 18 wherein said selection criteria is the text "color, number, shape, size and direction."

* * * * *